US008682229B2

(12) United States Patent
Minegishi et al.

(10) Patent No.: US 8,682,229 B2
(45) Date of Patent: Mar. 25, 2014

(54) DEVELOPING DEVICE WITH BIAS VOLTAGE AND IMAGE FORMING APPARATUS

(75) Inventors: Natsuko Minegishi, Hachioji (JP); Naoki Tajima, Sagamihara (JP); Seiko Itagaki, Hachioji (JP); Hiroyuki Saito, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 391 days.

(21) Appl. No.: 13/117,469

(22) Filed: May 27, 2011

(65) Prior Publication Data

US 2011/0299892 A1 Dec. 8, 2011

(30) Foreign Application Priority Data

Jun. 7, 2010 (JP) ..... 2010-129713

(51) Int. Cl.
*G03G 15/09* (2006.01)

(52) U.S. Cl.
USPC ..... 399/269; 399/270

(58) Field of Classification Search
USPC ..... 399/269, 270, 276
See application file for complete search history.

(56) References Cited

U.S. PATENT DOCUMENTS 7,502,579 B2 * 3/2009 Mabuchi et al. ..... 399/269

FOREIGN PATENT DOCUMENTS

JP 11-219022 A 8/1999

* cited by examiner

*Primary Examiner* — William J Royer
(74) *Attorney, Agent, or Firm* — Cantor Colburn LLP

(57) ABSTRACT

A developing device, includes a developer agitating member, an upstream side developing roller, and a downstream side developing roller; wherein a toner in a developer handed over from the upstream side developing roller to the downstream side developing roller has a volume average particle size larger than a volume average particle size of the toner in the developer conveyed by the upstream side developing roller to the facing position between the upstream side developing roller and a photoreceptor drum.

9 Claims, 3 Drawing Sheets

DEVELOPING DEVICE WITH BIAS VOLTAGE AND IMAGE FORMING APPARATUS

This application is based on Japanese Patent Application No. 2010-129713 filed on Jun. 7, 2010, in the Japanese Patent Office, the entire content of which is hereby incorporated by reference.

BACKGROUND OF THE INVENTION

The present invention relates to a developing device which makes developer adhere onto a photoreceptor which supports a latent image, and makes the latent image a visible image.

In developing devices which develop a latent image supported on a photoreceptor, developing devices which convey a two component developer (hereafter, merely referred to as developer) composed of toner and carrier by a developing roller constituted with a developing sleeve, which incorporates a magnet roller therein, to a facing portion to face the photoreceptor so as to make toner adhere onto a latent image on the photoreceptor and to make the latent image a visible image, are well known. Further, in order to obtain an image with high quality at high speed, a technique to convey developer with a plurality of developing rollers so as to develop a latent image is used (for example, Patent Document 1).

In the development by the plurality of developing rollers, first, toner is made to adhere onto a latent image on a photoreceptor at a developing region being a facing position between a developing sleeve (hereafter, referred to as an upstream side developing sleeve) of a developing roller (hereafter, along the direction in which developer is conveyed, referred to as an upstream side developing roller) which supports and conveys agitated developer, and a photoreceptor, and then the developer which have passed the developing region and remains on the upstream side developing sleeve is handed over to a developing sleeve (hereafter, referred to as a downstream side developing sleeve) of a developing roller (hereafter, along the direction in which developer is conveyed, referred to as a downstream side developing roller). The downstream side developing sleeve conveys the received developer to a developing region which is a facing portion between the downstream side developing sleeve and the photoreceptor and makes toner adhere onto the latent image on the photoreceptor.

As compared with the development by a single developing sleeve, high developing efficiency can be obtained with the development by the plurality of developing rollers. The developing efficiency can be increased with the development by the upstream side developing roller which supports and conveys agitated developer, and supplements the development by the upstream side developing roller with the development by the downstream side development, whereby high quality images at high speed can be realized.

Patent Document 1: Japanese Unexamined Patent Publication No. 11-219022, Official Report In the developing unit which uses a two component developer, optical density unevenness called sleeve memory may occur on an image.

In the development with the two component developer, toner supported on a developing sleeve shifts in a developing region onto the surface of a photoreceptor, and develops a latent image on the photoreceptor so as to form a toner image. Then, on the surface of the developing sleeve having passed the developing region, toner to develop a subsequent latent image is supported.

The sleeve memory is a defect phenomenon caused by the fact that toner is pressed onto the surface of the developing sleeve in the developing region and adheres on the surface of the developing sleeve. In the developing region, since toner is pressed onto a surface portion of the developing sleeve which faces non-image portions in a latent image on a photoreceptor, toner tends to adhere on there. On the other hand, for example, since toner is not pressed onto a surface portion of the developing sleeve which faces image portions in the latent image, toner is unlikely to adhere on there.

Although the developing sleeve having passed over the developing region supports toner for developing a subsequent latent image, the height of a toner layer on a surface portion of the developing sleeve on where toner adheres is higher than that of a toner layer on a surface portion on where toner adheres. Further, a difference in electric potential between image portions of the photoreceptor and the surface of the developing sleeve is larger at the portion on where toner adheres than at the portion on where toner does not adhere. Accordingly, when latent images to be developed with the same optical density are developed, the optical image density developed with the portion where toner adheres becomes higher than the optical image density developed with the portion where toner does not adhere.

Therefore, a phenomenon that the optical density of an image when a subsequent latent image was developed with the portion of the developing sleeve which faces a non-image portion in a latent image in the developing region and on where toner adheres, becomes higher than the optical density of an image when a subsequent latent image was developed with the portion (on where toner is unlikely to adhere) which faces an image portion, may occur. Sleeve memory means such a phenomenon.

The unevenness of the toner adhering on the developing sleeve may be removed by a layer thickness regulating member that regulates the thickness of a conveyed developer layer, i.e., a layer thickness, or a scraper to rub with sliding movement a developer layer on the surface of the developing sleeve, and the removal of the unevenness of toner prevents the occurrence of the sleeve memory. However, when being subjected to regulating of a layer thickness or rubbing with sliding movement, toner receives stress. Such stress causes lowering of charging ability of toner and lowering of fluidity, which results in lowering of the developing efficiency.

The developing unit disclosed by Patent Document 1 comprises a first developing roller equivalent to an upstream side developing roller and a second developing roller equivalent to a downstream side developing roller. Further, the developing unit is provided with a blade to regulate a layer thickness of developer conveyed by the first developing roller, and a scraper to scrape off developer from the second developing roller, so that the sleeve memory may be prevented. However, it is unavoidable that toner receives stress from the layer thickness regulating member and the scraper.

In the developing unit which is equipped with two or more developing rollers and a developer is handed over from an upstream side developing roller to a downstream side developing roller, agitated developer is supported and conveyed by a developing roller, i.e., an upstream side developing roller, and the layer thickness of toner supported on the upstream side developing roller is regulated by a layer thickness regulating member so as to make adhering toner drop of whereby the occurrence of the sleeve memory may be prevented. However, it is unavoidable that toner receives stress. Therefore, in order not to increase stress applied to toner, for example, it may be preferable not to arrange a layer thickness regulating member or a scraper around the downstream side developing roller. However, with this structure, the sleeve memory tends to occur.

SUMMARY OF THE INVENTION

The present invention has been made in view of the above problems, and an object of the present invention is to prevent the occurrence of the sleeve memory in the developing device having a plurality of developing rollers without enlarging stress for toner.

The above object may be attained by the following techniques.

A developing device, comprising:

a developer agitating member that mixes and agitates developer containing toner particles and carrier particles;

an upstream side developing roller that supports the developer which is mixed and agitated by the developer agitating member, conveys the developer to a facing position opposite to a photoreceptor drum which carries a latent image, and develops the latent image carried by the photoreceptor drum by making toner particles in the developer to adhere to the latent image under a bias voltage composed of a DC bias and an AC bias; and a downstream side developing roller that is located at a downstream side of the upstream side developing roller in the rotating direction of the photoreceptor drum, supports the developer handed over from the upstream side developing roller, conveys the developer to a facing position opposite to the photoreceptor which carries the latent image, and develops the latent image carried by the photoreceptor drum by making toner particles in the developer to adhere the latent image under a bias voltage composed of a DC bias and an AC bias;

wherein the toner in the developer handed over from the upstream side developing roller to the downstream side developing roller has a volume average particle size larger than that of the toner in the developer conveyed by the upstream side developing roller to the facing position between the upstream side developing roller and the photoreceptor.

DETAILED DESCRIPTION OF THE PREFERRED EMBODIMENT

Hereafter, embodiments of the present invention will be explained. The description in this section does not intend to limit or restrict the technical range of claims and the meaning of technical terms.

Figure 1:
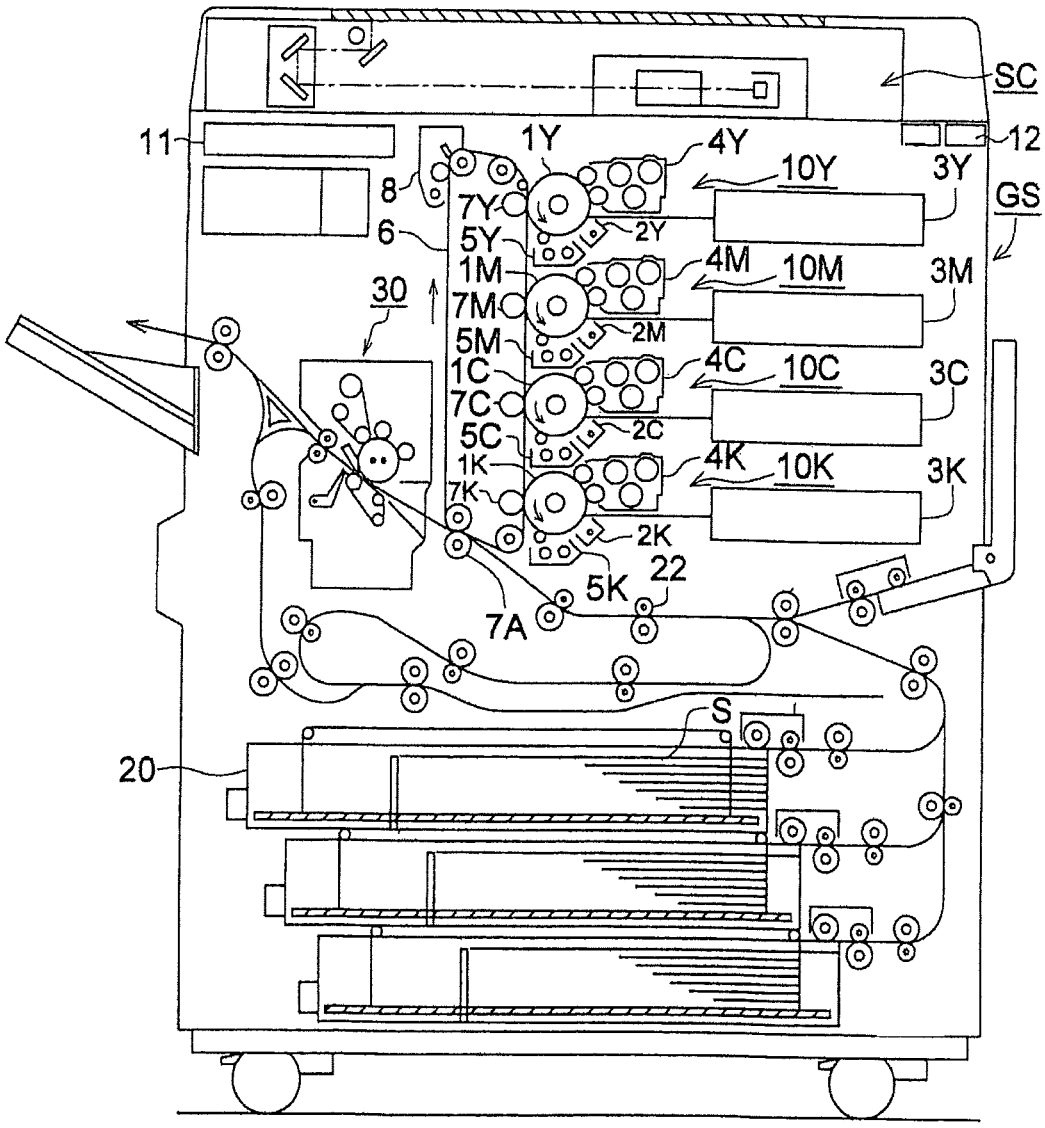
FIG. 1 is a structural diagram of an image forming apparatus in which a fixing device according to the present invention is installed.

FIG. 1 is a structural diagram of an image forming apparatus in which a fixing device according to the present invention is installed.

An image forming apparatus GS is called a tandem type color image forming apparatus, and has four sets of image forming sections.

Images of a document placed on a document stand is subjected to scanning exposure by an optical system of a document image scanning exposure device of an image reading device SC, is read into a line image sensor, and converted into image information signals. The resultant image information signals are subjected to analog processing, A/D conversion, shading correction, image compression processing and the like in an image processing section, and then input to an optical write-in section of an image forming section.

The image forming section includes an image forming section 10Y to form an yellow (Y) color image, an image forming section 10M to form a magenta (M) color image, an image forming section 10C to form a cyan (C) color image, and an image forming section 10K to form a black (K) color image, that is, the respective image forming sections are expressed with a common number 10 and subsequent symbols Y, M, C, K which show a color to be formed.

The image forming section 10Y is structured with a photoreceptor drum 1Y being an image supporting body, and an electrically charging section 2Y, an optical write-in section 3Y, a developing section 4Y, and a drum cleaner 5Y which are arranged around the photoreceptor drum 1Y.

Similarly, the image forming section 10M is structured with a photoreceptor drum 1M being an image supporting body, and an electrically charging section 2M, an optical write-in section 3M, a developing section 4M, and a drum cleaner 5M which are arranged around the photoreceptor drum 1M, the image forming section 10C is structured with a photoreceptor drum 1C being an image supporting body, and an electrically charging section 2C, an optical write-in section 3C, a developing section 4C, and a drum cleaner 5C which are arranged around the photoreceptor drum 1C, and the image forming section 10K is structured with a photoreceptor drum 1K being an image supporting body, and an electrically charging section 2K, an optical write-in section 3K, a developing section 4K, and a drum cleaner 5K which are arranged around the photoreceptor drum 1K.

In the image forming sections 10Y, 10M, 10C, and 10K, the photoreceptor drums 1Y 1M, 1C, and 1K, the electrically charging sections 2Y, 2M, 2C, and 2K, the optical write-in sections 3Y, 3M, 3C, and 3K, the developing devices 4Y, 4M, 4C, and 4K, and the drum cleaners 5Y, 5M, 5C, and 5K are structured with the common content, respectively. Accordingly, hereafter, these devices are expressed without attaching symbols Y, M, C and K except the case where distinction is required particularly.

The image forming section 10 writes an image based on image information signals on the photoreceptor drum 1 by the optical write-in section 3, and forms a latent image based on the image information signals on the photoreceptor drum 1. The developing device 4 makes toner to adhere to the resultant latent image so that the resultant latent image is developed to form a visible image on the photoreceptor drum 1.

The image forming sections 10Y, 10M, 10C, and 10K form an yellow (Y) color image, a magenta (M) color image, a cyan (C) color image, and a black (K) color image on the photoreceptor drums 1Y, 1M, 1C, and 1K respectively.

An intermediate transfer belt 6 is wound around two or more rollers, and is supported to be able to run.

Respective color images formed by the image forming sections 10Y, 10M, 10C, and 10K are transferred sequentially onto the running intermediate transfer belt 6 by primarily transferring sections 7Y, 7M, 7C, and 7K, whereby a color image is formed on the intermediate transfer belt 6.

A recording sheet S accommodated in a sheet feeding cassette 20 is fed out by a feeding section (a first sheet feeding section) 21, and conveyed to a secondary transfer section 7A via a registration roller (a second sheet feeding section) 22, whereby the color image is transferred onto the recording sheet S. The recording sheet S on which the color image (toner image) is transferred is nipped by a fixing device 30 so as to be applied with heat and pressure, whereby the toner image on the recording sheet S is fixed, and then the recording sheet S is discharged.

On the other hand, after the color image is transferred onto the recording sheet S by the secondary transfer section 7A and the recording sheet S is separated from the intermediate transfer belt 6, residual toner is removed from the intermediate transfer belt 6 by a transfer belt cleaner 8.

The size of the recording sheet S and the number of the recording sheets S used for image formation are set from an operation display section 11 installed at an upper portion of the main body of the image forming apparatus GS.

Moreover, a main power supply switch 12 to turn on or off a main power source to execute image formation processing is provided in the vicinity of the upper portion of the main body of the image forming apparatus GS.

In the above description for the image forming apparatus GS, color image formation is explained. However, monochrome image formation is also included in the present invention.

Hereafter, the photoreceptor drum 1 and developing device 4 in the image forming section 10 will be explained.

Figure 2:
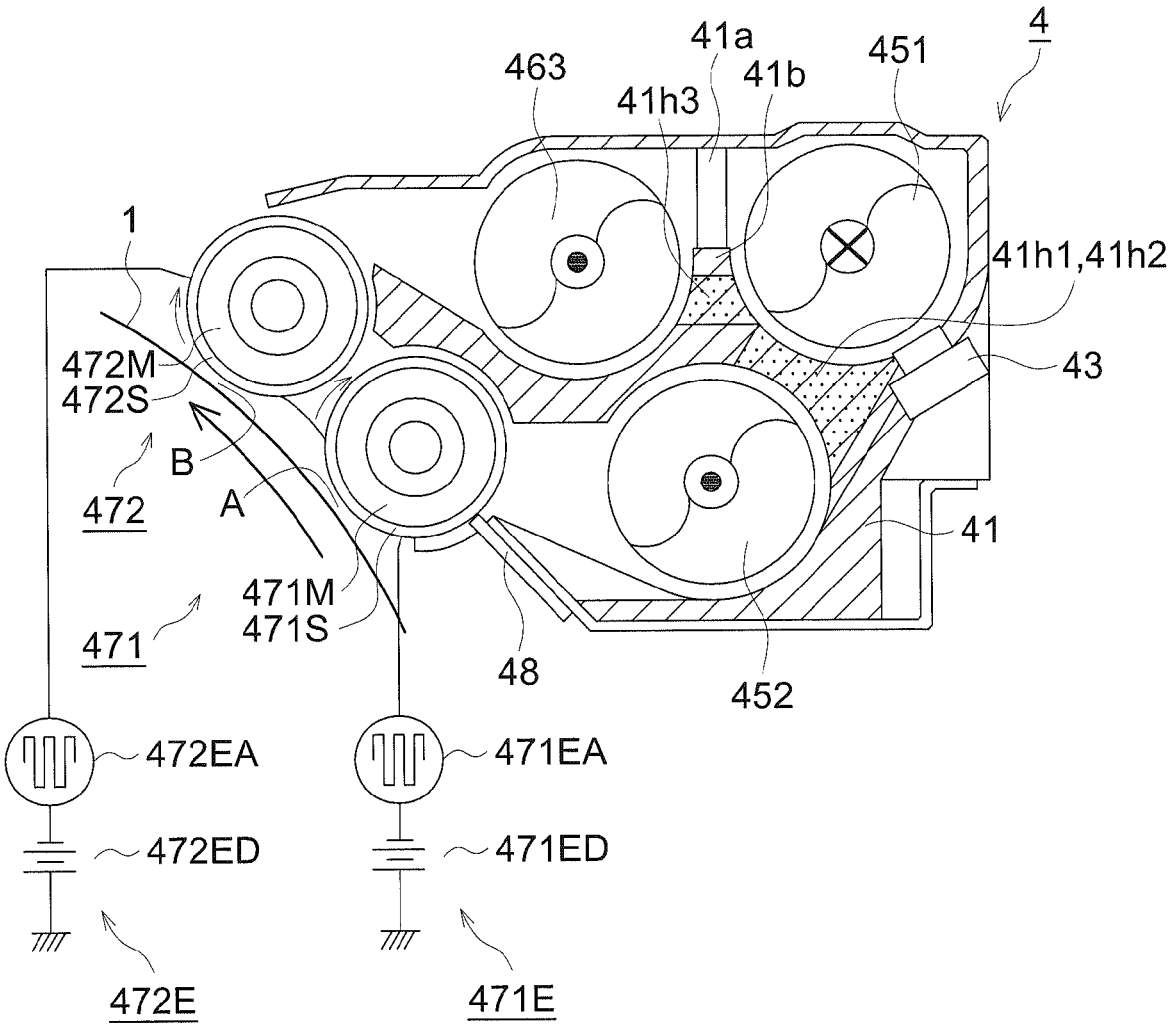
FIG. 2 is a drawing for explaining a developing device which is an example of embodiments of the present invention, and its periphery.

FIG. 2 is a drawing for explaining a developing device 4, which is an example of an embodiment of the present invention, and its periphery. The photoreceptor drum 1 is driven to rotate in the counterclockwise direction in the drawing and a first developing roller 471 and a second developing roller 472 of the developing device 4 are arranged opposite to this photoreceptor drum 1. The photoreceptor drum 1 and the first developing roller 471, and the second developing roller 472 are rotated in the arrow direction as shown in the drawing the first developing roller 471 functions as an upstream side developing roller, and the second developing roller 472 functions as a downstream side developing roller.

The first developing roller 471 and the second developing roller 472 support and convey developer composed of toner and carrier, and make the toner in this developer to adhere to a latent image on the photoreceptor drum 1 so as to form a toner image which is a visible image.

The first developing roller 471 has a first developing sleeve 471S and a first magnet roll 471M. The first magnet roll 471M is incorporated in the first developing sleeve 471S.

The second developing roller 472 has a second developing sleeve 472S and a second magnet roll 472M. The second magnet roll 472M is incorporated in the second developing sleeve 472S.

The first developing sleeve 471S and the second developing sleeve 472S are respectively a nonmagnetic cylindrical member made of for example, a stainless steel material, and their outer circumferential surfaces are subjected to a roughening process. The roughening process for the outer circumferential surface will be explained later.

The first developing sleeve 471S and the second developing sleeve 472S are arranged opposite to the circumferential surface of the photoreceptor drum 1 with a predetermined gap, and are constituted to be rotated in the same direction (clockwise rotation direction shown in FIG. 2) as the rotation direction (counterclockwise rotation direction shown in FIG. 2) of the photoreceptor drum 1 at the mutually-facing position by a not-shown rotation driving section.

The first magnet roll 471M and the second magnet roll 472M are respectively incorporated inside the first developing sleeve 471S and the second developing sleeve 472S, and respectively fixed concentrically with the first developing sleeve 471S and the second developing sleeve 472S. In the first magnet roll 471M and the second magnet roll 472M, two or more magnets are arranged alternately so as to exert magnet forces onto the circumferential surfaces of the nonmagnetic first developing sleeve 471S and second developing sleeve 472S.

At the right side of the first and second developing roller 471 and 472, three screw rollers are arranged such that respective shafts are respectively positioned almost at one of three corners of an inverted triangle.

In the drawing, numeral 451 represents an agitating screw roller, numeral 452 represents a feeding screw roller, and numeral 463 represents a recovering screw roller. The feeding screw roller 452 is rotated in the clockwise direction, and the recovering screw roller 463 and the agitating screw roller 451 are rotated in the counterclockwise direction, respectively by a not-shown driving section. The feeding screw roller 452 and the recovering screw roller 463 convey developer from the rear side to the front side in the drawing and the agitating screw roller 451 conveys developer from the front side to the rear side in the drawing. Herein, in the drawing, the mark "•" and the mark "x" which are indicated at the shaft of each screw roller, respectively represent the leading end (•) and the trailing end (x) of the arrow mark indicating the conveying direction of the developer.

A space between screw rollers is partitioned with a partition wall 41 indicated with hatching in the drawing, so that this partition wall and the screw roller constitute a conveyance passage for developer.

The conveyance passage of the feeding screw roller 452 and the conveyance passage of the agitating screw roller 451 are communicated with each other by openings 41*h*1 and 41*h*2 provided respectively at a feed start side and a feed end side of the respective conveyance passages, so that the feeding screw roller 452 conveys developer in the reverse direction relatively to that of the agitating screw roller 451. Toner and carrier in developer are fully mixed and agitated in the course of conveyance by the agitating screw roller 451. The agitating screw roller 451 functions as a developer agitating member.

Further, the recovering screw roller 463 communicates with the agitating screw roller 451 via an opening 41*h*3 (shown with dot hatching in FIG. 2) so that the developer conveyed by the recovering screw roller 463 is handed over to the agitating screw roller 451.

The partition wall 41 between the recovering screw roller 463 and the agitating screw roller 451 is constructed such that a partition wall 41*a* at the rear side in the drawing is made high and a partition wall 41*b* at the front side is made low. Since the partition wall 41*b* at the front side in FIG. 2 is made low, a part of developer conveyed by the recovering screw roller 463 passes over the partition wall 41*b*, moves to the agitating screw roller 451 side, and is added to the agitated developer.

On the other hand, the remainder of the developer conveyed by the recovering screw roller 463 is conveyed to the end side, and is handed over to the agitating screw roller 451 through the opening 41*h*3. However, if the amount of developers is too much, the remainder of the developer is discharged from a discharging port (not shown) provided at the end of the recovering screw roller 463.

Since toner is consumed by development, the toner concentration in the developer, which circulates through the inside of the developing device 4, lowers. The developing device 4 of this embodiment is a trickle development type, and if toner concentration lowers, developer in which toner and carrier are mixed, is supplied from a not-shown developer supply opening. As shown in FIG. 2, a toner concentration sensor 43 is provided in the vicinity of the end of the agitating screw roller 451, and a developer supply amount is determined based on the detection signal of this toner concentration sensor 43, and then a developer is supplied.

The supplied developer is mixed and agitated with the circulated developer by the agitating screw roller 451 which functions as a developer agitating member, and is supplied to the fist developing roller 471 by the feeding screw roller 452. On the other hand, if an amount of developer becomes too much, a superfluous developer is discharged from the discharging opening (not-shown) provided at the end of the recovering screw roller 463, and the amount of the developer which circulates through the inside of the developing device 4 is maintained within an appropriate range.

Next, the operation of the developing device of the present invention and the flow of developer will be explained.

The agitating screw roller 451 driven so as to rotate mixes and agitates developer. The feeding screw roller 452 driven so as to rotate conveys developer, and pushes up the developer to the agitating screw roller 451 side from the opening 41*h*1 provided on a partition wall between the feeding screw roller 452 and the agitating screw roller 451. The agitating screw roller 451 mixes and agitates the developer pushed up by the feeding screw roller 452 while conveying it. Successively, the agitating screw roller 451 conveys again the developer to the feeding screw roller 452 through the opening 41*h*2 provided at the end of the agitating screw roller 451.

When developer is agitated by the agitating screw roller 451, toner is charged by friction and becomes a state that toner adheres electrostatically on the external surface of carrier.

The developer in which toner adheres on the external surface of carrier, adheres on a circumferential surface of the first developing sleeve 471S by the action of the first magnet roll 471M in the first developing roller 471 from a space portion between the feeding screw roller 452 and the first developing roller 471. A layer thickness regulating member 48 regulates a developer conveyance amount of the first developing sleeve 471S by regulating the thickness of a layer of the developer adhering on the circumferential surface of the first developing sleeve 471S to a predetermined thickness. For example, the developer conveyance amount in this embodiment is 220 $g/m^2$.

The developer is conveyed with the rotation of the first developing sleeve 471S to a first developing region A which is a facing position between the first developing roller 471 and the photoreceptor drum 1.

The developer is supported by the first developing sleeve 471S in the first developing region A, and toner in the conveyed developer leaves from carrier, and adheres to a latent image on the photoreceptor drum 1, whereby development is made.

The surface of the photoreceptor drum 1 is uniformly charged by a charging section 2, and then irradiated with output light beam LB based on image information by an optical write-in section 3, whereby the electric potential of the irradiated portions is changed from the charge potential of the portions charged by the charging section 2.

If the charge potential of the portions charged by the charging section 2 is $V_{D0}$, and when the photoreceptor drum 1 is irradiated with the output light beam LB, the electric potential of the irradiated portion changes from the charge potential $V_{D0}$. The electric potential of the irradiated portion is made to $V_{DP}$. Portions having the electric potential $V_{DP}$ are portions having been irradiated with the output light beam, i.e., image portions, and portions having the electric potential $V_{D0}$ are portions having been not irradiated with the output light beam, i.e., non image portions. The latent image formed on the photoreceptor drum 1 consists of image portions having the electric potential $V_{DP}$ and non image portions having the electric potential $V_{D0}$.

The developing device 4 visualizes a latent image, i.e., conducts development by making toner to adhere on image portions of a latent image formed on the photoreceptor drum 1.

The first developing roller 471 is applied with a developing bias by a first bias power source 471E. The first bias power source 471E includes a first direct current power source 471ED which is a direct current power source, and a first alternate current power source 471 EA which is an alternate current power source. The developing bias in which an AC bias by the first alternate current power source 471EA is superimposed on a DC bias by the first direct current power source 471ED is applied onto the first developing roller 471.

When the developer supported by the rotating first developing sleeve 471S arrives at the first developing region A facing the photoreceptor drum 1, toner (charged with a negative potential) in the conveyed developer leaves from carrier, and moves and adheres to the image portions in the latent image on the photoreceptor drum 1 by the action of the developing bias applied to the first developing roller 471. At this time, the carrier is attracted on the first developing sleeve 471S by the magnetism of the first magnet roll 471M, and does not shift to the photoreceptor drum 1.

When the toner shifts from the first developing sleeve 471S and adheres to the image portion of the latent image formed on the photoreceptor drum 1, the latent image formed on the photoreceptor drum 1 becomes a toner image which is a visible image.

The toner which did not shift to the photoreceptor drum 1 in the first developing region A and remains on the circumferential surface of the first developing sleeve 471S, and the carrier which does not shift to the photoreceptor drum 1 pass over the first developing region A with the rotation of the first developing sleeve 471S. Then, when the toner and the carrier arrives at the facing portion between the first developing roller 471 and the second developing roller 472, the toner and the carrier are handed over from the first developing roller 471 to the second developing roller 472 by the mutual action between the first magnet roll 471M and the second magnet roll 472M.

The developer handed over to the second developing sleeve 472S is conveyed with the rotation of the second developing sleeve 472S to a second developing region B which is a facing position between the second developing roller 472 and the photoreceptor drum 1.

The second developing roller 472 is applied with a developing bias by a second bias power source 472E. The second bias power source 472E includes a second direct current power source 472ED which is a direct current power source, and a second alternate current power source 472EA which is an alternate current power source. The developing bias in which an AC bias by the second alternate current power source 472EA is superimposed on a DC bias by the second direct current power source 472ED is applied onto the second developing roller 472.

In the second developing region B, toner (charged with a negative potential) in the conveyed developer leaves from carrier, and moves and adheres to the image portions in the latent image on the photoreceptor drum 1 by the action of the developing bias applied to the second developing roller 472.

At this time, the carrier is attracted on the second developing sleeve 472S by the magnetism of the second magnet roll 472M, and does not shift to the photoreceptor drum 1.

When the toner shifts from the second developing sleeve 472S and adheres to the image portion of the latent image formed on the photoreceptor drum 1, the latent image formed on the photoreceptor drum 1 becomes a toner image which is a visible image.

The developer remaining on the second developing sleeve 472S after having passed over the second developing region B is made to separate and drop from the second developing sleeve 472S by the action of the magnetism of the second magnet roll 472M. The developer separated from the second developing sleeve 472S is conveyed by the recovering screw roller 463, and is further conveyed to the agitating screw roller 451 from the opening 41*h*3 at the end of the recovering screw roller 463.

Then, the conveyed developer is mixed and agitated with the developer, which is not used for development, by the agitating screw roller 451.

In this way, while the developer is being mixed and agitated by the agitating screw roller 451 functioning as a developer agitating member, a part of the developer is supplied from the feeding screw roller 452 to the first developing roller 471, and used for development in the first developing region A, and further, handed over to the second developing roller 472, and used for development in the second developing region B. Successively, after the development in the second developing region B, the developer which remains on the second developing roller 472 is again returned to the agitating screw roller 451 by the recovering screw roller 463, agitated by the agitating screw roller 451, supported by the first developing sleeve 471S, and used in a circulation manner.

"Sleeve memory" is a phenomenon caused by the fact that fresh developer is supported by the developing sleeve on which the adhering developer is left as it is.

If the developing sleeve, on which the developer having passed over the developing region still adheres, supports fresh developer thereon, the height of a developer layer supported on a portion of the surface where the developer adheres is larger than that on a portion where the developer does not adheres. Further, when the developer layer is conveyed to the developing region, an electric potential difference between an image portion on the photoreceptor drum and the developer layer on a portion where the developer adheres becomes larger that on a portion where the developer does not adhere. Therefore, when developing a latent image to be developed with the same image density, the image density developed with the portion where the developer adheres becomes higher than that developed with the portion where the developer does not adhere. This phenomenon is called "sleeve memory and lowers image quality.

The thickness of the layer of the developer which is supported by the first developing sleeve 471S so as to adhere on the circumferential surface of the first developing sleeve 471S is regulated by the layer thickness regulating member 48.

Then, in the course that the layer thickness of the supported developer is regulated by the layer thickness regulating member 48, even when the developer adheres on the circumferential surface of the first developing sleeve 471S, the adhering developer is removed from the first developing sleeve 471S. Therefore, the sleeve memory due to the developer adhering on the first developing sleeve 471S hardly occurs. This action of the layer thickness regulating member 48 becomes a factor which adds stress to developer, it is indispensable to regulate the layer thickness of the developer supported by the first developing sleeve 471S in order to perform development appropriately, and the arrangement of the layer thickness regulating member 48 is indispensable.

In the developing device 4, a member which adds stress to developer is not arranged other than the layer thickness regulating member 48. Therefore, the stress applied to the developer is small, so that the lowering of charging properties and the lowering of fluidity due to the addition of stress to the developer are suppressed and development is conducted with high development efficiency. However, on the other hand, there is intrinsically a risk that developer adheres on the second developing sleeve 472S so as to cause sleeve memory.

In the developing device 4 in the embodiment of the present invention, the developing bias applied to the first developing roller 471 and the surface structure (surface roughness) of the first developing sleeve 471S are set within proper ranges so as to prevent sleeve memory from occurring on the second developing roller 472.

Generally, toner in developer has dispersion in particle size around the volume average particle size as the center of distribution. It is well known that toner particles with small particle sizes tend to adhere on the developing sleeve than toner particles with large particle sizes.

Toner particles are supported by the developing sleeve on the condition that the toner particles adhere on carrier particles, and are conveyed in the developing region. At this time, toner particles with large particle sizes leave easily from the carrier particles and are used easily for development. Further, when adhering on the latent image on the photoreceptor drum after leaving from the carrier particles, the toner particles with large particle sizes tend to leave from the photoreceptor drum.

On the other hand, toner particles with small particle sizes leave hardly from the carrier particles, and when adhering on the latent image on the photoreceptor drum after leaving from the carrier particles, the toner particles with small particle sizes leave hardly from the photoreceptor drum. Namely, toner particles with small particle sizes are used not easily for development. However, when toner particles with small particle sizes adhere on the photoreceptor drum by development, the toner particles is unlikely to leave from the photoreceptor drum.

Then, in the developing device 4, the volume average particle size $D_{T2}$ of the toner of the developer handed over from the first developing roller 471 to the second developing roller 472 is constituted to become larger than the volume average particle size $D_{T0}$ of the toner of the developer which is agitated by the agitating screw roller 451 being a developer agitating member and supported by the first developing sleeve 471S, i.e., the developer supported by the first developing roller 471. The matter that the volume average particle size of the toner of the developer handed over from the first developing roller 471 to the second developing roller 472 is larger than the volume average particle size of the toner of the developer which is supported by the first developing roller 471 and conveyed to the first developing region A, means that the content ratio of toner particles with small particle sizes contained in the developer handed over from the first developing roller 471 to the second developing roller 472 is small, whereby sleeve memory is prevented from occurring on the second developing roller 472. Here, in order to exert the effect of the present invention, the volume average particle size $D_{T0}$ (μm) and the volume average particle size $D_{T2}$ (μm) satisfy the following formulas.

$$5.0 \leq D_{T0} \leq 10.0$$

$$D_{T0} < D_{T2}$$

$$0.1 \leq \Delta D \leq 1.0, \text{ where } \Delta D = D_{T2} - D_{T0}.$$

In the developing device 4, the conditions of the developing bias applied to the first developing roller 471 is set appropriately such that toner particles with small particle sizes shift from the first developing sleeve 471S to the photoreceptor drum 1 in the first developing region A, so that the content ratio of toner particles with small particle sizes contained in the developer remaining on the first developing sleeve 471S after having passed over the first developing regions A, i.e., after development in the first developing regions A has been completed, is made small. In addition, the surface structure (surface roughness) of the first developing sleeve 471S is set appropriately such that toner particles with small particle sizes adhering on the first developing sleeve 471S is made to hardly separate from the first developing sleeve 471S, so that the content ratio of toner particles with small particle sizes contained in the developer handed over from the first developing roller 471 to the second developing roller 472 is made small. As a result, since the content ratio of toner particles with small particle sizes contained in the developer handed over to the second developing roller 472 is made small, it becomes possible to prevent sleeve memory from occurring on the second developing roller 472.

Next, the developing bias applied to the first developing roller 471 so as to characterize the developing device 4 will be explained.

As mentioned above, a latent image is formed on the photoreceptor drum 1. The electric potential on the surface of the photoreceptor drum 1 is configured such that the electric potential on image portions where are irradiated with an output light beam is made lower than that on non image portions where are not irradiated with an output light beam.

And then, the first developing roller 471 is applied with a developing bias in which an AC bias by the first alternate current power source 471EA is superimposed on a DC bias by the first direct current power source 471ED in the first bias power source 471E.

Figure 3:
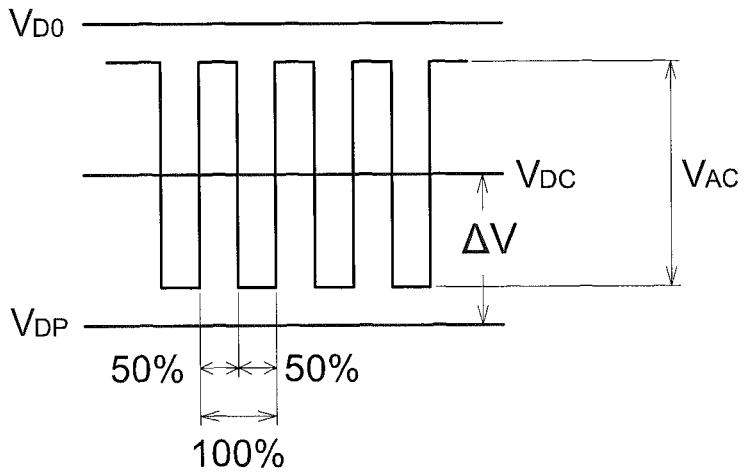
FIG. 3 is a drawing for explaining a surface potential of a photoreceptor drum and a developing bias applied to a first developing roller.

FIG. 3 is a drawing for explaining the surface potential on the photoreceptor drum 1 and the developing bias applied to the first developing roller 471.

In the drawing, $V_{D0}$ represents an electric potential on portions on the photoreceptor drum 1 which are not subjected to write-in by the optical write-in section 3, i.e., non image portions, and $V_{DP}$ represents an electric potential on portions on the photoreceptor drum 1 which are subjected to write-in by the optical write-in section 3, i.e., image portions.

The developing bias in which an AC bias is superimposed on a DC bias is applied to the first developing roller 471.

In the drawing, $V_{DC}$ represents the voltage of the DC bias, and $V_{AC}$ represents the peak-to-peak value of the AC bias. The AC bias is made in a rectangular waveform which has not a quiescent period, a phase ratio (duty ratio) with which an electric field is applied in the direction to shift toner particles from the first developing roller 471 to the photoreceptor drum 1 in one cycle is 50%.

The developing device 4 is configured to satisfy the conditional formula $V_{AC}/\Delta V \geq 0.7$, wherein $\Delta V$ represents a difference in potential between the voltage value $V_{DC}$ of the DC bias applied to the first developing roller 471 and the charge potential $V_{DP}$ of the image portions in the latent image on the photoreceptor drum 1, and $V_{AC}$ represents the peak-to-peak value of the AC bias.

In this way, with the setting of $V_{AC}/\Delta V \geq 0.7$, when the developer supported by the first developing sleeve 471S becomes opposite to image portions on the photoreceptor drum 1 in the first developing region A, toner particles with small particle sizes which hardly separate from carrier particles are made separate from the carrier particles so as to adhere on the image portions, so that toner particles with small particle sizes can be reduced from the developer supported by the first developing sleeve 471S. Further, when the developer becomes opposite to non image portions on the photoreceptor drum 1, toner particles with small particle sizes which floats in the space in the first developing region A between the photoreceptor drum 1 and the first developing sleeve 471S, are pressed onto the first developing sleeve 471S so as to adhere on the surface of the first developing sleeve 471S. When the developer is handed over from the first developing sleeve 471S to the second developing sleeve 472S, toner particles with small particle sizes remain on the surface of the first developing sleeve 471S and do not shift to the second developing sleeve 472S.

Accordingly, the volume average particle size of the toner of the developer which is handed over from the first developing roller 471 to the second developing roller 472 and has a small content ratio of toner particles with small particle sizes, becomes larger than is constituted to become larger than the volume average particle size of the toner of the developer which is agitated by the agitating screw roller 451 being a developer agitating member and supported by the first developing sleeve 471S and contains toner particles with small particle sizes. Accordingly, in the developer which is handed over from the first developing roller 471 to the second developing roller 472, the content ratio of toner particles with small particle sizes is small, whereby sleeve memory is prevented from occurring on the second developing roller 472. Here, in consideration of voltage leakage and the like, it is preferable that ($V_{AC}/\Delta V$) is 10 or less. $0.7 \leq V_{AC}/\Delta V \leq 10$ Next, the surface structure of the first developing sleeve 471S by which the developing device 4 of the present invention is characterized, especially the surface roughness will be explained.

As stated previously, in the developing device 4 of the present invention, a stainless steel SUS is used as the material of the first developing sleeve 471S and the second developing sleeve 472S, and the respective surfaces are roughened by use of alumina particles or spherical glass bead particles as abrasive particles so as to provide convexo-concave unevenness, whereby conveying force for developer is strengthened.

In the developing device 4, the surface roughness of the first developing sleeve 471S is specified with a ten point average roughness Rz (JIS B0601) and the convexo-concave average convex (mountain) interval Sm (JIS B0601). Herein, the ten point average roughness Rz represents a level difference between mountains and valleys in convexo-concave unevenness on the surface of the developing sleeve 471S, and the average convex interval Sm represents an average interval of neighboring mountains on the surface of the developing sleeve 471S.

In the developing device 4, the ten point average roughness Rz (μm) on the surface of the first developing sleeve 471S is made in a range of $Rz \geq D_D/8$, and the convexo-concave average convex interval Sm (μm) on the surface of the first developing sleeve 471S is made in a range of $2D_{TO} \leq Sm < 2D_D$, where $D_{TO}$ represents the volume average particle size of the toner in the developer which is mixed and agitated by the agitating screw roller 451 being a developer agitating member and supplied to the first developing roller 471, and $D_D$ represents the volume average particle size of the carrier in the developer.

It is preferable that the ten point average roughness Rz (μm) on the surface of the first developing sleeve 471S is 35 or less. The measurement of the above surface roughness is conducted by the use of a contact type surface roughness meter: Surfcoder SE-3300 (trade name) manufactured by Kosaka Laboratory Co., Ltd.

With the application of such a surface structure, toner particles with small particle sizes pressed against the first developing sleeve 471S at the first developing region A are caught with the surface of the first developing sleeve 471S, the caught toner particles are made not to leave from the first developing sleeve 471S only by the electric field condition, and also the toner particles caught at concave portions on the surface of the first developing sleeve 471S are prevented from being scraped off easily by carrier particles and being handed over to the second developing sleeve 472S.

Therefore, as compared with the volume average particle size of the toner in the developer which is supported by the first developing roller 471 and contains toner particles with small particle sizes, the volume average particle size of the toner in the developer which is handed over from the first developing roller 471 to the second developing roller 472 and has a small content ratio of toner particles with small particle sizes, can be made large so that the occurrence of sleeve memory caused by the second developing roller 472 can be prevented. Since toner particles adhering on the first developing sleeve 471S are usually removed by the layer thickness regulating member 48, sleeve memory caused by the first developing roller 471 does not occur. Further, in the case where adhering toner particles are not removed by the layer thickness regulating member 48, sleeve memory caused by the first developing roller 471 my occur temporally. However, the resultant development is compensated with the development by the second developing roller 472, so that image quality is not influenced.

Namely, as shown in FIG. 2, in the preferable embodiment of the present invention, the first developing roller 471 at the first developing region A and the second developing roller 472 at the second developing region B are rotated respectively in the same direction as the photoreceptor drum 1. Accordingly, a latent image on the photoreceptor drum 1 is firstly developed by the first developing roller 471, and then the latent image is further developed by the developer which is handed over from the first developing roller 471 to the second developing roller 472 and has a small content ratio of toner particles with particle sizes.

In the above development, it is preferable that the gap distance GB in the second developing region B between the second developing roller 472 and the photoreceptor drum 1 is smaller than the gap distance GA in the first developing region A between the first developing roller 471 and the photoreceptor drum 1. Further, it is preferable that the line speed SB of the second developing roller 472 is larger than the line speed SA of the first developing roller 471, and more preferably, the line speed SA and the line speed SB satisfy the following conditional formula.

$$1<SB/SA\leq 2$$

In the present invention, when $D_{T0}$ represents the volume average particle size of the toner particle in the developer which is supported by the upstream side developing roller (i.e., the first developing roller 471 in the developing device 4) and conveyed to the first developing region A, $D_{T1}$ represents the volume average particle size of the toner particles which were used to development in the first developing region A and adhere to the photoreceptor drum 1, and $D_{T2}$ represents the volume average particle size of the toner in the developer which is handed over from the upstream side developing roller having passed through the first developing region A to the downstream side developing roller (i.e., the second developing roller 472 in the developing device 4), $D_{T2}$ is made larger than $D_{T0}$ ($D_{T2}>D_{T0}$), whereby the occurrence of sleeve memory can be prevented. Further, when ΔV represents a difference in potential between the voltage value $V_{DC}$ of the DC bias applied to the first developing roller 471 and the charge potential $V_{DP}$ of the image portions in the latent image on the photoreceptor drum 1, and $V_{AC}$ represents the peak-to-peak value of the AC bias, the setting is made to satisfy the conditional formula $V_{AC}/\Delta V\geq 0.7$, whereby the conditional formula $D_{T2}>D_{T0}$ is established so as to prevent the occurrence of sleeve memory.

The test results of checking whether the setting to make the range of the bias condition applied to the first developing roller 471 to satisfy the conditional formula $V_{AC}/\Delta V\geq 0.7$ is effective to prevent sleeve memory, are shown hereinafter.

The checking was conducted by Examples 1 to 5 and Comparative examples 1 and 2 in which setting conditions for the developing devices 4Y, 4M, 4C, and 4K in the image forming apparatus GS were changed partially.

The setting conditions in Examples 1 to 5 and Comparative examples 1 and 2 are shown below.

Process speed: 750 mm/s

Development method: two component development method (developer composed of toner and carrier is used)

Number of developing rollers: two rollers (each of an upstream side developing roller and downstream side developing roller is one roller)

The upstream and downstream rollers respectively rotate in the reverse direction to the rotation direction of the photoreceptor drum.

The developer which is supported and conveyed by the upstream side developing sleeve after having passed the developing region is handed over to the downstream side developing sleeve.

<Upstream Side Developing Sleeve>

Outside diameter: 25 mm 10 point average roughness Rz: 10 μm

Average convex interval Sm of convexo-concave roughness on the surface: this value was set respectively for each of Examples 1 to 5 and Comparative examples 1 and 2.

Distance for a photoreceptor drum: 280±30 μm

Developer conveyance quantity: 220±30 g/m$^2$

The developer regulating member is arranged opposite to the upstream side developing sleeve.

Development θ: 1.0

Development θ=(developing sleeve line speed)/(photoreceptor drum line speed)

Developing bias

DC bias

Voltage $V_{DC}$: $\Delta V=|V_{DC}-V_{DP}|$ was respectively set for each of Examples 1 to 5 and Comparative examples 1 and 2 ($V_{DP}$ represents the electric potential of image portions on the photoreceptor drum).

AC bias

Frequency: 9 kHz

Duty ratio: 50%

Peak-to-peak voltage $V_{AC}$: this value was set respectively for each of Examples 1 to 5 and Comparative examples 1 and 2.

<Down Side Developing Sleeve>

Outside diameter: 25 mm

Distance for a photoreceptor drum: 230±30 μm

Developer conveyance quantity: 180±25 g/m$^2$

Development θ: 1.2

Development θ=(developing sleeve line speed)/(photoreceptor drum line speed)

10 point average roughness Rz: 10 μm

Sm: this value was set respectively for each of Examples 1 to 5 and Comparative examples 1 and 2.

Developing bias

DC bias

Voltage $V_{AC}$: $\Delta V=|V_{DC}-V_{DP}|$ was respectively set for each of Examples 1 to 5 and Comparative examples 1 and 2 ($V_{DP}$ represents the electric potential of image portions on the photoreceptor drum).

AC bias

Frequency: 9 kHz

Duty ratio: 50%

Peak-to-peak voltage VAC: this value was set respectively for each of Examples 1 to and Comparative examples 1 and 2.

<Developer>

Carrier volume average particle size $D_D$: 33 μm

Toner concentration: 9% by weight

Toner volume average particle size $D_{T0}$: 6.5 μm

The above date are the setting conditions of the developing devices 4Y, 4M, 4C, and 4K in Examples 1 to 5 and Comparative examples 1 and 2.

The setting conditions set differently for each of Examples 1 to 5 and Comparative examples 1 and 2 are shown hereafter.

Average convex interval Sm of convexo-concave roughness on the surface of the upstream side developing sleeve Example 1: 35 μm Example 2: 75 μm Example 3: 35 μm Example 4: 35 μm Example 5: 75 μm Comparative example 1: 75 μm Comparative example 2: 75 μm ΔV on the upstream side roller ($\Delta V=|V_{DC}-V_{DP}|$, $V_{DP}$ represents the electric potential of image portions on the photoreceptor drum)

Example 1: 380 V

Example 2: 350 V

Example 3: 350 V

Example 4: 350 V

Example 5: 380 V

Comparative example 1: 420 V

Comparative example 2: 420 V

Peak-to-peak voltage $V_{AC}$ of AC bias on the upstream side roller

Example 1: 300 V

Example 2: 800 V

Example 3: 800 V

Example 4: 800 V

Example 5: 280 V

Comparative example 1: 200 V

Comparative example 2: 280 V

Average convex interval Sm of convexo-concave roughness on the surface of the downstream side developing sleeve Example 1: 75 μm Example 2: 35 μm Example 3: 75 μm Example 4: 75 μm Example 5: 75 μm Comparative example 1: 75 μm Comparative example 2: 75 μm ΔV on the downstream side roller ($\Delta V=|V_{DC}-V_{DP}|$, $V_{DP}$ represents the electric potential of image portions on the photoreceptor drum)

Example 1: 380 V

Example 2: 350 V

Example 3: 350 V

Example 4: 350 V

Example 5: 380 V

Comparative example 1: 420 V

Comparative example 2: 420 V

Peak-to-peak voltage $V_{AC}$ of AC bias on the downstream side roller

Example 1: 300 V

Example 2: 300 V

Example 3: 500 V

Example 4: 300 V

Example 5: 280 V

Comparative example 1: 280 V

Comparative example 2: 280 V

The above data are setting values set differently for Examples 1 to 5 and Comparative examples 1 and 2.

The setting values set differently for Examples 1 to 5 and Comparative examples 1 and 2 are shown in Table 1.

TABLE 1

| | | Example 1 | Example 2 | Example 3 | Example 4 | Example 5 | Comp. 1 | Comp. 2 |
|---|---|---|---|---|---|---|---|---|
| First | Sm (μm) | 35 | 75 | 35 | 35 | 75 | 75 | 75 |
| developing | ΔV (V) | 380 | 350 | 350 | 350 | 380 | 420 | 420 |
| roller | $V_{AC}$ (V) | 300 | 800 | 800 | 800 | 280 | 200 | 280 |
| Second | Sm (μm) | 75 | 35 | 75 | 75 | 75 | 75 | 75 |
| developing | ΔV (V) | 380 | 350 | 350 | 350 | 380 | 420 | 420 |
| roller | $V_{AC}$ (V) | 300 | 300 | 500 | 300 | 280 | 280 | 280 |

Comp.: Comparative example

As stated above, when $D_{T0}$ represents the volume average particle size of the toner particle in the developer which is supported by the upstream side developing roller being the first developing roller 471 in the developing device 4 and conveyed to the first developing region A, and $D_{T2}$ represents the volume average particle size of the toner in the developer which is handed over from the upstream side developing roller having passed through the first developing region A to the downstream side developing roller being the second developing roller 472, $D_{T2}$ is made larger than $D_{T0}$ ($D_{T2}>D_{T0}$), whereby the occurrence of sleeve memory can be prevented. Further, when ΔV represents a difference in potential between the voltage value $V_{DC}$ of the DC bias applied to the first developing roller 471 and the charge potential $V_{DP}$ of the image portions in the latent image on the photoreceptor drum 1, and $V_{AC}$ represents the peak-to-peak value of the AC bias, the setting is made to satisfy the conditional formula $V_{AC}/\Delta V\geq 0.7$, whereby the conditional formula $D_{T2}>D_{T0}$ is established so as to prevent the occurrence of sleeve memory.

The respective values of $V_{AC}/\Delta V$ in Examples 1 to 5 and Comparative examples 1 and 2 and the evaluation results as to whether the values satisfy the conditional formula $V_{AC}/\Delta V \geq 0.7$ are shown in Table 2.

TABLE 2

| | Example 1 | Example 2 | Example 3 | Example 4 | Example 5 | Comp. 1 | Comp. 2 |
|---|---|---|---|---|---|---|---|
| ΔV (V) | 380 | 350 | 350 | 350 | 380 | 420 | 420 |
| $V_{AC}$ (V) | 300 | 800 | 800 | 800 | 280 | 200 | 280 |
| $V_{AC}/\Delta V$ | 0.79 | 2.29 | 2.29 | 2.29 | 0.74 | 0.48 | 0.67 |
| $V_{AC}/\Delta V \geq 0.7$ ? | Yes | Yes | Yes | Yes | Yes | No | No |

Comp.: Comparative example

As shown in Table 2, Examples 1 to 5 satisfy the conditional formula $V_{AC}/\Delta V \geq 0.7$ and Comparative examples 1 and 2 do not satisfy the conditional formula $V_{AC}/\Delta V \geq 0.7$.

The existence or non-existence of the occurrence of sleeve memory was checked in Examples 1 to 5 and Comparative examples 1 and 2.

The checking was conducted in terms of the following two check items when an image formation was conducted by the employment of Examples 1 to 5 and Comparative examples 1 and 2. Here, the checking was conducted by the use of the image forming section 10K to form black image with which the existence or non-existence of the occurrence of sleeve memory can be remarkably checked.

One of the check items is comparison between the volume average particle size $D_{T2}$ of the toner in the developer which is handed over from the first developing roller 471 to the second developing roller 472 and the volume average particle size ($D_{T0}$: 6.5 μm) of the toner particle in the developer which is conveyed to the first developing region A by the first developing roller 471, i.e., agitated by the agitating screw roller 451 being the developer agitating member and supplied to the first developing roller 471.

First, the entire surface of the photoreceptor drum 1 (concretely, photoreceptor drum 1K) was subjected to write-in by the optical write-in section 3 (concretely, the optical write-in section 3K) so that the electric potential of the entire surface of the photoreceptor drum 1 (concretely, photoreceptor drum 1K) was made to $V_{DP}$, i.e., image portions, and then subjected to development by the developing device 4 (concretely, the developing device 4K). A part of the developer was sampled from the first developing sleeve 471S which has passed the position (i.e., developing region) opposite to the photoreceptor drum 1 (concretely, photoreceptor drum 1K) and was moving toward a position opposite to the second developing roller 472, and the volume average particle size $D_{T2}$ of the toner contained in the sampled developer was measured and the resultant size was compared with the volume average particle size $D_{T0}$ of the toner contained in the used developer.

The measurement of the volume average particle size ($D_{T0}$, $D_{T2}$) of the toner is conducted by the use of Coulter counter Multisizer r3 (trade name) manufactured by Beckman Coulter Corporation.

Another check item is to check whether sleeve memory has occurred in the image output to a recording paper sheet. When the sleeve memory has occurred, the optical density of the outputted image rises. Therefore, when an image to become the same optical density is output, the existence or non-existence of the occurrence of sleeve memory can be evaluated by the existence or non-existence of a difference in optical density. In the check mentioned below, indexes (L*, a*, b*), in L*a*b* color system, of an output image set to become the same optical density were measured, and the existence or non-existence of the occurrence of sleeve memory is judged from the resultant measurements.

Here, the L*a*b* color system is a color system used for expressing the color of an object, was standardized by International Illumination Commission (CIE) in 1976, and was adopted as JIS (Z8729) even in Japan. In the L*a*b* color system, the lightness is represented with L*, and the chromaticity which indicates a hue and saturation, is represented with a* and b*.

More concretely, a toner image with a predetermined pattern is formed and output on a recording sheet, indexes (L*, a*, b*), in the L*a*b* color system, of the output image are measured, and the existence or non-existence of the occurrence of sleeve memory is judged from the measurement results.

Figure 4:
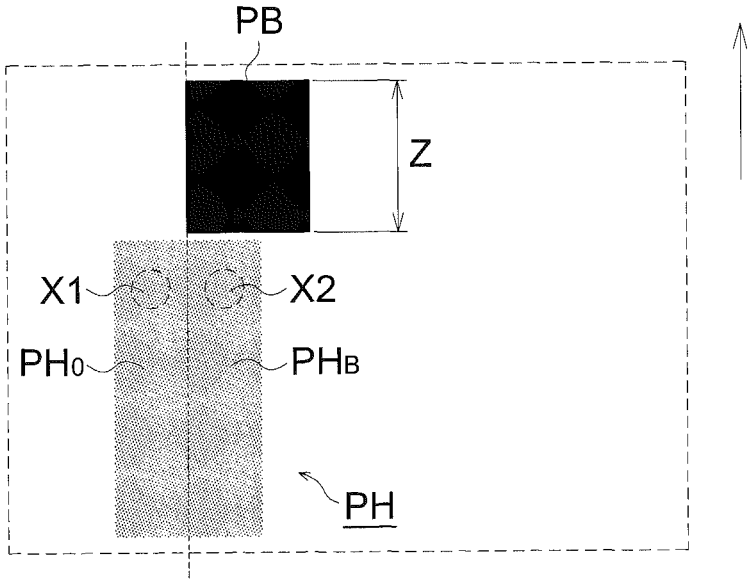
FIG. 4 is a drawing showing an example of an image pattern for judging existence or non-existence of the occurrence of a sleeve memory.

FIG. 4 is an illustration showing an example of an image pattern used for judging the existence or non-existence of the occurrence of sleeve memory. The illustrated image pattern is premised to be output on a A4 size sheet shown with a broken line. In the illustration, an arrowed mark indicates a proceeding direction of an image, PB represents a portion to be output with a solid image, and PH represents a portion to be output with a halftone image.

The solid portion PB is formed in a rectangle composed of two sides parallel to the proceeding direction of an image and two sides intersect perpendicularly with the proceeding direction of the image. In the illustration, Z represents a length of the solid portion PB in the proceeding direction of the image and is made the length corresponding to an outer circumferential length around the upstream side developing sleeve. In the developing device 4, the outer diameter of the first developing sleeve 471S is 25 mm and the length corresponding to its outer circumferential length is 78.5 mm. Accordingly, Z is set to Z=78.5 mm.

The halftone portion PH is formed in a rectangle composed of two sides parallel to the proceeding direction of an image and two sides intersect perpendicularly with the proceeding direction of the image at the back of the solid portion PB in the proceeding direction of the image. The center portion of the halftone portion PH in the direction perpendicular to the proceeding direction of the image is arranged to coincide, in position, with the trailing end of the solid portion PB. In the illustration, $PH_B$ is a section of the halftone portion which follows the solid portion PB and $PH_O$ is a section of the halftone portion which follows the non image portion (i.e., the section at the left side of the solid portion PB).

An image pattern is first formed on the photoreceptor drum 1 as a latent image.

The electric potential of the region of the photoreceptor drum 1 corresponding to the solid portion PB is made $V_{DP}$, i.e., the region is made to 100% image portion, and the electric potential of 40% of the region of the photoreceptor drum 1 corresponding to the halftone portion PH is made $V_{DP}$, i.e., the region is made to 40% image portions. The electric potential of the region other than the 40% image portions of the photoreceptor drum 1 is made $V_{D0}$, i.e., the region is made to non image portions. These image and non image portions are formed as a latent image with write-in by the optical write-in section 3. The photoreceptor drum 1 on which the image pattern is formed is developed by the developing device 4 to form a toner image, and the resulting toner image is transferred onto a recording sheet, fixed and outputted.

Then, the indexes (L*, a*, b*) in the L*a*b* color system in the image pattern formed on the outputted recording sheet are measured, whether sleeve memory takes place or not is judged from the measurement results.

As mentioned above, the sleeve memory is a phenomenon in which on the condition that toner adheres on a facing portion opposite to non-image portions (tend to make toner adhere) in the latent image in the developing region, when the subsequent latent images are developed, the optical density of the images developed by the facing portion opposite to the non-image portions becomes higher than that of images developed by a facing portion opposite to image portions (unlikely to make toner adhere). Therefore, in the recording sheet on which the image pattern is output, when the optical density of the portion $PH_B$, which follows the solid portion PB, in the halftone portion PH is compared with the optical density of the portion $PH_O$, which follows the non-image portion, in the halftone portion PH, if an optical density difference exceeding a predetermined value is confirmed between the portion $PH_B$ and the portion $PH_O$, it is judged that sleeve memory takes place. Here, in FIG. 4, X1 represents an optical density measurement region on which the optical density of the portion $PH_O$, which follows the non-image portion, in the halftone portion PH is measured, and X2 represents an optical density measurement region on which the optical density of the portion $PH_B$, which follows the solid image portion PB, in the halftone portion PH is measured.

Accordingly, the optical density measurement regions X1 and X2 in the image pattern output to the recording sheet are respectively subjected to the measurement of the indexes E (L*, a*, b*) in the L*a*b* color system.

Then, a color difference ΔE is obtained from the obtained index E1 (L1, a1, b1) of the optical density measurement region X1 and the index E2 (L2, a2, b2) of the optical density measurement region X2.

Here, when it is supposed that ΔL=L1−L2, Δa=a1−a2, Δb=b1−b2 based on the measurement values E1 (L1, a1, b1) in the region A and the measurement values E2 (L2, a2, b2) in the region B, ΔE is calculated by the following equation.

$$\Delta E=(\Delta L^2+\Delta a^2+\Delta b^2)^{1/2}$$

Subsequently, it is judged that when the calculated color difference ΔE is in a range exceeding a threshold value of 0.6 (ΔE>0.6), the occurrence of the sleeve memory is acknowledged, and when the calculated color difference ΔE is in a range not exceeding the threshold value of 0.6 (ΔE≤0.6), the occurrence of the sleeve memory is not acknowledged. Herein, the threshold value of 0.6 is a boundary value between good and bad in image quality, which is determined separately by experiment, and is used as a threshold value to judge existence or non-existence of the occurrence of sleeve memory in such a way that (ΔE>0.6) is judged as poor (C), (0.5<ΔE≤0.6) is judged as good (B), and (ΔE≤0.5) is judged as excellent (A).

The check results are indicated in Table 3.

TABLE 3

| | Example 1 | Example 2 | Example 3 | Example 4 | Example 5 | Comp. 1 | Comp. 2 |
|---|---|---|---|---|---|---|---|
| ΔV (V) | 380 | 350 | 350 | 350 | 380 | 420 | 420 |
| $V_{AC}$ (V) | 300 | 800 | 800 | 800 | 280 | 200 | 280 |
| $V_{AC}/\Delta V$ | 0.79 | 2.29 | 2.29 | 2.29 | 0.74 | 0.48 | 0.67 |
| $V_{PP}/\Delta V \geq 0.7$ ? | Yes | Yes | Yes | Yes | Yes | No | No |
| $D_{T0}$ (μm) | 6.5 | 6.5 | 6.5 | 6.5 | 6.5 | 6.5 | 6.5 |
| $D_{T2}$ (μm) | 6.9 | 7.3 | 7.4 | 7.4 | 6.7 | 6.4 | 6.4 |
| $D_{T2} > D_{T0}$ ? | Yes | Yes | Yes | Yes | Yes | No | No |
| ΔE | 0.47 | 0.38 | 0.26 | 0.13 | 0.59 | 0.92 | 0.75 |
| Judgment of sleeve memory | AA | AA | AA | AA | A | C | C |

Comp.: Comparative example

As shown in Table 3, Examples 1 to 5 which satisfy the conditional formula $V_{AC}/\Delta V \geq 0.7$, satisfy the conditional formula $D_{T2}>D_{T0}$, and also satisfy the conditional formula ΔE≤0.6. Namely, the volume average particle size $D_{T2}$ of the toner particle in the developer which is handed over from the first developing roller 471 having passed through the first developing region A to the second developing roller 472 becomes larger than the volume average particle size $D_{T0}$ of the toner particle in the developer which is conveyed by the first developing roller 471 to the first developing region A, and the occurrence of the sleeve memory is not acknowledged. On the other hand, Comparative examples 1 and 2 which do not satisfy the conditional formula $V_{AC}/\Delta V \geq 0.7$, do not satisfy the conditional formula $D_{T2}>D_{T0}$, and also do not satisfy the conditional formula ΔE≤0.6, that is, satisfy ΔE>0.6. Namely, the volume average particle size $D_{T2}$ of the toner particle in the developer which is handed over from the upstream side developing roller to the downstream side developing roller does not become larger than the volume average particle size $D_{T0}$ of the toner particle in the developer which is conveyed to the first developing region A, and the occurrence of the sleeve memory is acknowledged.

Next, when developer having a volume average particle size of 7.5 μm and developer having a volume average particle size of 8.5 μm were used for Examples 1 to 5 and Comparative examples 1 and 2, Table 4 shows the measurement results of the volume average particle size $D_{T2}$ of the toner particle in the developer which is handed over from the first developing roller 471 to the second developing roller 472 and the volume average particle size $D_{T0}$ of the toner particle in the developer which is conveyed by the first developing roller 471 to the first developing region A, and existence on non-existence of the occurrence of the sleeve memory.

TABLE 4

| | Example 1 | Example 2 | Example 3 | Example 4 | Example 5 | Comp. 1 | Comp. 2 |
|---|---|---|---|---|---|---|---|
| $V_{PP}/\Delta V \geq 0.7$ ? | Yes | Yes | Yes | Yes | Yes | No | No |
| | | | $D_{T0}$ = 7.5 μm | | | | |
| $D_{T0}$ (μm) | 7.5 | 7.5 | 7.5 | 7.5 | 7.5 | 7.5 | 7.5 |
| $D_{T2}$ (μm) | 7.9 | 8.4 | 8.5 | 8.5 | 7.7 | 7.3 | 7.4 |
| $D_{T2} > D_{T0}$ ? | Yes | Yes | Yes | Yes | Yes | No | No |
| Judgment of sleeve memory | AA | AA | AA | AA | A | C | C |
| | | | $D_{T0}$ = 8.5 μm | | | | |
| $D_{T0}$ (μm) | 8.5 | 8.5 | 8.5 | 8.5 | 8.5 | 8.5 | 8.5 |
| $D_{T2}$ (μm) | 8.9 | 9.4 | 9.5 | 9.5 | 8.9 | 8.4 | 8.4 |
| $D_{T2} > D_{T0}$ ? | Yes | Yes | Yes | Yes | Yes | No | No |
| Judgment of sleeve memory | AA | AA | AA | AA | A | C | C |

Comp.: Comparative example

As shown in Table 4, even in the case where the developer different in the volume average particle size $D_{T0}$ of the toner particle was used, Examples 1 to 5 which satisfy the conditional formula $V_{AC}/\Delta V \geq 0.7$, satisfy the conditional formula $D_{T2} > D_{T0}$, and the occurrence of the sleeve memory is not acknowledged. On the other hand, Comparative examples 1 and 2 which do not satisfy the conditional formula $V_{AC}/\Delta V \geq 0.7$, do not satisfy the conditional formula $D_{T2} > D_{T0}$, and the occurrence of the sleeve memory is acknowledged.

In this way, when the conditional formula $V_{AC}/\Delta V \geq 0.7$ is satisfied, the conditional formula $D_{T2} > D_{T0}$ is satisfied, that is, the volume average particle size $D_{T2}$ of the toner particle in the developer which is handed over from the upstream side developing roller to the downstream side developing roller can be made larger than the volume average particle size $D_{T0}$ of the toner particle in the developer which is mixed and agitated by the agitating screw roller 451 being the developer agitating member and supported by the upstream side developing roller. Namely, when the conditional formula $V_{AC}/\Delta V \geq 0.7$ is satisfied, it is verified that the occurrence of the sleeve memory can be suppressed.

Next, when $D_{TO}$ represents the volume average particle size of the toner in the used developer and $D_D$ represents the volume average particle size of the carrier in the developer, the test results of checking whether a range of $Rz \geq D_D/8$ in the ten point average roughness Rz on the surface of the upstream side developing sleeve and a range of $2D_{TO} \leq Sm < 2D_D$ in the average convex interval Sm on the surface of the upstream side developing sleeve are preferable for preventing the sleeve memory, are shown.

The checking was conducted by Examples 11 to 15 and Comparative examples 11 and 17 in which setting conditions for the developing devices 4Y, 4M, 4C, and 4K in the image forming apparatus GS were changed partially.

The setting conditions of the developing devices 4Y, 4M, 4C, and 4K in Examples 11 to 15 and Comparative examples 11 and 17 are shown below.

Process speed: 750 mm/s

Development method: two component development method (developer composed of toner and carrier is used)

Number of developing rollers: two rollers (each of an upstream side developing roller and downstream side developing roller is one roller)

The upstream and downstream developing rollers respectively rotate in the reverse direction to the rotation direction of the photoreceptor drum.

The developer which is supported and conveyed by the upstream side developing sleeve after having passed the developing region is handed over to the downstream side developing sleeve.

<Upstream Side Developing Sleeve>

Outside diameter: 25 mm 10 point average roughness Rz: this value was set respectively for each of Examples 11 to 15 and Comparative examples 11 and 17.

Average convex interval Sm of convexo-concave roughness on the surface: this value was set respectively for each of Examples 11 to 15 and Comparative examples 11 and 17.

Distance for a photoreceptor drum: 280±30 μm

Developer conveyance quantity: 220±30 g/m$^2$

The developer regulating member is arranged opposite to the upstream side developing sleeve.

Development θ: 1.0

Development θ=(developing sleeve line speed)/(photoreceptor drum line speed)

Developing bias

DC bias

Voltage $V_{DC}$: $\Delta V = |V_{DC} - V_{DP}|$ was set to 380 V ($V_{DP}$ represents the electric potential of image portions on the photoreceptor drum.

AC bias

Frequency: 9 kHz

Duty ratio: 50%

Peak-to-peak voltage $V_{AC}$: 266 V

<Downstream Side Developing Sleeve>

Outside diameter: 25 mm

Distance for a photoreceptor drum: 230±30 μm

Developer conveyance quantity: 180±25 g/m$^2$

Development θ: 1.2

Development θ=(developing sleeve line speed)/(photoreceptor drum line speed)

10 point average roughness Rz: 10 μm

Sm: 75 μm

Developing bias

DC bias

Voltage $V_{DC}$: $\Delta V = |V_{DC} - V_{DP}|$ was set to 380 V ($V_{DP}$ represents the electric potential of image portions on the photoreceptor drum).

AC bias

Frequency: 9 kHz

Duty ratio: 50%

Peak-to-peak voltage VAC: 266 V

<Developer>

Carrier volume average particle size $D_D$: this value was set respectively for each of Examples 11 to 15 and Comparative examples 11 and 17.

Toner concentration: 9% by weight

Toner volume average particle size $D_{T0}$: this value was set respectively for each of Examples 11 to 15 and Comparative examples 11 and 17.

The above date are the setting conditions of the developing devices 4Y, 4M, 4C, and 4K in Examples 11 to 15 and Comparative examples 11 and 17.

The setting conditions set differently for each of Examples 11 to 15 and Comparative examples 11 and 17 are shown hereafter.

Example 13: $D_D$=33 μm, $D_{TO}$=6.5 μm

Example 14: $D_D$=33 μm, $D_{TO}$=7.5 μm

Example 15: $D_D$=40 μm, $D_{TO}$=8.0 μm

Comparative example 11: $D_D$=25 μm, $D_{TO}$=5.5 μm

Comparative example 12: $D_D$=30 μm, $D_{TO}$=6.0 μm

Comparative example 13: $D_D$=33 μm, $D_{TO}$=6.5 μm

Comparative example 14: $D_D$=33 μl, $D_{TO}$=7.5 μm

Comparative example 15: $D_D$=40 μl, $D_{TO}$=8.0 μm

Comparative example 16: $D_D$=33 μl, $D_{TO}$=6.5 μm

Comparative example 11: $D_D$=40 μl, $D_{TO}$=8.0 μm

The above data are setting values set differently for Examples 11 to 15 and Comparative examples 11 and 17.

The value of $V_{AC}/\Delta V$ and the check results whether the conditional formula $V_{AC}/\Delta V \geq 0.7$ is satisfied or not, in Examples 11 to 15 and Comparative examples 11 and 17, and the setting values set differently for Examples 11 to 15 and Comparative examples 11 and 17 are shown in Table 5.

TABLE 5

| | Example 11 | Example 12 | Example 13 | Example 14 | Example 15 | Comp. 11 | Comp. 12 | Comp. 13 | Comp. 14 | Comp. 15 | Comp. 16 | Comp. 17 |
|---|---|---|---|---|---|---|---|---|---|---|---|---|
| ΔV (V) | 380 | 380 | 380 | 380 | 380 | 380 | 380 | 380 | 380 | 380 | 380 | 380 |
| $V_{AC}$ (V) | 266 | 266 | 266 | 266 | 266 | 266 | 266 | 266 | 266 | 266 | 266 | 266 |
| $V_{AC}/\Delta V$ | 0.70 | 0.70 | 0.70 | 0.70 | 0.70 | 0.70 | 0.70 | 0.70 | 0.70 | 0.70 | 0.70 | 0.70 |
| $V_{AC}/\Delta V \geq 0.7$ ? | Yes | Yes | Yes | Yes | Yes | Yes | Yes | Yes | Yes | Yes | Yes | Yes |
| Rz (μm) | 10 | 10 | 10 | 10 | 10 | 10 | 10 | 10 | 10 | 10 | 4 | 4 |
| Sm (μm) | 20 | 35 | 35 | 65 | 18 | 50 | 66 | 75 | 14 | 15 | 35 | 66 |
| $D_{T0}$ (μm) | 5.5 | 6.0 | 6.5 | 7.5 | 8.0 | 5.5 | 6.0 | 6.5 | 7.5 | 8.0 | 6.5 | 8.0 |
| $D_D$ (μm) | 25 | 30 | 33 | 33 | 40 | 25 | 30 | 33 | 33 | 40 | 33 | 40 |

Comp.: Comparative example

Ten point average roughness Rz and average convex interval Sm of convexo-concave roughness on the surface of the upstream side developing sleeve Example 11: Rz=10 μm, Sm=20 μm Example 12: Rz=10 μm, Sm=35 μm Example 13: Rz=10 μm, Sm=35 μm Example 14: Rz=10 μm, Sm=65 μm Example 15: Rz=10 μm, Sm=18 μm Comparative example 11: Rz=10 μm, Sm=50 μm Comparative example 12: Rz=10 μm, Sm=66 μm As shown in Table 5, Examples 11 to 15 and Comparative examples 11 and 17 respectively satisfy the conditional formula $V_{AC}/\Delta V \geq 0.7$.

The results of checking whether the range of the ten point average roughness Rz on the surface of the upstream side developing sleeve of respective Examples 11 to 15 and Comparative examples 11 and 17 is within $Rz \geq D_D/8$ and whether the range of the average convex interval Sm of concavo-convex roughness is within $2D_{TO} \leq Sm < 2D_D$, are shown in Table 6.

TABLE 6

| | Example 11 | Example 12 | Example 13 | Example 14 | Example 15 | Comp. 11 | Comp. 12 | Comp. 13 | Comp. 14 | Comp. 15 | Comp. 16 | Comp. 17 |
|---|---|---|---|---|---|---|---|---|---|---|---|---|
| Rz (μm) | 10 | 10 | 10 | 10 | 10 | 10 | 10 | 10 | 10 | 10 | 4 | 4 |
| Sm (μm) | 20 | 35 | 35 | 65 | 18 | 50 | 66 | 75 | 14 | 15 | 35 | 66 |
| $D_{T0}$ (μm) | 5.5 | 6.0 | 6.5 | 7.5 | 8.0 | 5.5 | 6.0 | 6.5 | 7.5 | 8.0 | 6.5 | 8.0 |
| $2D_{T0}$ (μm) | 11 | 12 | 13 | 15 | 16 | 11 | 12 | 13 | 15 | 16 | 13 | 16 |
| $D_D$ (μm) | 25 | 30 | 33 | 33 | 40 | 25 | 30 | 33 | 33 | 40 | 33 | 40 |
| $D_D/8$ (μm) | 3.1 | 3.8 | 4.1 | 4.1 | 5.0 | 3.1 | 3.8 | 4.1 | 4.1 | 5.0 | 4.1 | 5.0 |
| $2D_D$ (μm) | 50 | 60 | 66 | 66 | 80 | 50 | 60 | 66 | 66 | 80 | 66 | 80 |
| $Rz \geq D_D/8$ ? | Yes | Yes | Yes | Yes | Yes | Yes | Yes | Yes | Yes | Yes | No | No |
| $2D_{T0} \leq Sm < 2D_D$ ? | Yes | Yes | Yes | Yes | Yes | No | No | No | No | No | Yes | Yes |

Comp.: Comparative example

Comparative example 13: Rz=10 μm, Sm=75 μm

Comparative example 14: Rz=10 μm, Sm=14 μm

Comparative example 15: Rz=10 μm, Sm=15 μm

Comparative example 16: Rz=4 μm, Sm=35 μm

Comparative example 17: Rz=4 μm, Sm=66 μm

Volume average particles size $D_D$ of carrier and volume average particle size $D_{TO}$ of toner in developer Example 11: $D_D$=25 μm, $D_{TO}$=5.5 μm Example 12: $D_D$=30 μm, $D_{TO}$=6.0 μm As shown in Table 6, Examples 11 to 15 satisfy the conditional formulas of $Rz \geq D_D/8$ and $2D_{TO} \leq Sm < 2D_D$. On the other hand, Comparative examples 11 and 15 satisfy the conditional formula of $Rz \geq D_D/8$, but do not satisfy the conditional formula of $2D_{TO} \leq Sm < 2D_D$, and Comparative examples 16 and 17 satisfy the conditional formula of $2D_{TO} \leq Sm < 2D_D$, but do not satisfy the conditional formula of $Rz \geq D_D/8$.

When an image formation was conducted by each of Examples 11 to 15 and Comparative examples 11 and 17, existence or non-existence of the occurrence of the sleeve memory was checked. In the checking, the image pattern shown in FIG. 4 was output on a recording sheet with K color (black) with which existence or non-existence of the occurrence of the sleeve memory is appreciably checked, and indexes E1 (L1, a1, b1) and indexes E2 (L2, a2, b2) in the L*a*b* color system on the optical density measurement regions X1 and X2 on the image pattern output on the recording sheet were measured. Successively, existence or non-existence of the occurrence of the sleeve memory was checked by the values of color difference ΔE calculated based on the indexes E1 (L1, a1, b1) and the indexes E2 (L2, a2, b2). When the calculated color difference ΔE is in a range exceeding the threshold value of 0.6 (ΔE>0.6), since the occurrence of the sleeve memory is acknowledged, (ΔE>0.6) was judged as poor (C). When the calculated color difference ΔE is in a range not exceeding the threshold value of 0.6 (ΔE≤0.6), since the occurrence of the sleeve memory is not acknowledged, (0.5<ΔE≤0.6) was judged as good (B), and (ΔE≤0.5) was judged as excellent (A).

The results of checking are shown in Table 7.

TABLE 7

| | Example 11 | Example 12 | Example 13 | Example 14 | Example 15 | Comp. 11 | Comp. 12 | Comp. 13 | Comp. 14 | Comp. 15 | Comp. 16 | Comp. 17 |
|---|---|---|---|---|---|---|---|---|---|---|---|---|
| $V_{AC}/\Delta V \geq 0.7$ ? | Yes | Yes | Yes | Yes | Yes | Yes | Yes | Yes | Yes | Yes | Yes | Yes |
| $Rz \geq D_D/8$ ? | Yes | Yes | Yes | Yes | Yes | Yes | Yes | Yes | Yes | Yes | No | No |
| $2D_{T0} \leq Sm < 2D_D$ ? | Yes | Yes | Yes | Yes | Yes | No | No | No | No | No | Yes | Yes |
| Judgment of sleeve memory | AA | AA | AA | AA | AA | A | A | A | A | A | A | A |

Comp.: Comparative example

Since each of Examples 11 to 15 and Comparative examples 11 and 17 satisfied the conditional formula $V_{AC}/\Delta V \geq 0.7$, there was no occurrence of the sleeve memory.

However, although there was no occurrence of the sleeve memory, difference was occurred in image quality.

In Comparative examples 11 and 15 which satisfy the conditional formula of $Rz \geq D_D/8$, but do not satisfy the conditional formula of $2D_{TO} \leq Sm < 2D_D$, and Comparative examples 16 and 17 which satisfy the conditional formula of $2D_{TO} \leq Sm < 2D_D$, but do not satisfy the conditional formula of $Rz \geq D_D/8$, the judgment results were good (B). In contrast, in Examples 11 to 15 which satisfy the conditional formulas of $Rz \geq D_D/8$ and $2D_{TO} \leq Sm < 2D_D$, the judgment results were excellent (A).

Thus, the provision of Rz and Sm so as to satisfy the conditional formulas of $Rz \geq D_D/8$ and $2D_{TO} \leq Sm < 2D_D$ onto the upstream side sleeve can enhance the prevention effect of the sleeve memory.

The abovementioned preferred embodiments of the present invention can be summarized as follows.

Item 1. In a developing device which includes a developer agitating member that mixes and agitates developer containing toner particles and carrier particles; an upstream side developing roller that supports the developer which is mixed and agitated by the developer agitating member, conveys the developer to a facing position opposite to a photoreceptor which carries a latent image, and develops the latent image carried by the photoreceptor by making toner particles in the developer to adhere the latent image under a bias voltage composed of a DC bias and an AC bias; and a downstream side developing roller that supports the developer handed over from the upstream side developing roller, conveys the developer to a facing position opposite to a photoreceptor which carries the latent image, and develops the latent image carried by the photoreceptor by making toner particles in the developer to adhere the latent image under a bias voltage composed of a DC bias and an AC bias; the developing device is characterized in that the toner in the developer handed over from the upstream side developing roller to the downstream side developing roller has a volume average particle size larger than that of the toner in the developer conveyed by the upstream side developing roller to the facing position between the upstream side developing roller and the photoreceptor.

Item 2. The developing device described in Item 1 is characterized in that when ΔV represents a difference in electric potential between the DC bias applied to the upstream side developing roller and an electric potential of image portions in the latent image on the photoreceptor, and $V_{AC}$ represents a peak-to-peak value of the AC bias applied to the upstream side developing roller, the following conditional formula is satisfied.

$$V_{AC}/\Delta V \geq >0.7$$

Item 3. The developing device described in Item 2 is characterized in that the upstream side developing roller comprises a magnet roller and a developing sleeve which incorporates the magnet roller therein, and when $D_{TO}$ represents a volume average particle size of toner in the developer which is mixed and agitated by the developing agitating member and $D_D$ represents a volume average particle size of carrier in the developer, a range of a ten point average roughness on a surface of the developing sleeve is $RZ \geq D_D/8$, and a range of an average convex interval SM on a convexo-concave rough surface is $2D_{TO} \leq Sm \leq 2D_D$.

Item 4. An image forming apparatus is characterized by being provided with the developing device described in any one of Items 1 to 3.

It is possible to provide a developing device that includes a plurality of developing rollers capable of preventing the occurrence of the sleeve memory without enlarging stress for toner.

Although the embodiments of the present invention are described above, the present invention is not limited to these embodiments and various modifications may be made.

What is claimed is:

1. A developing device, comprising:

a developer agitating member that mixes and agitates developer containing toner particles and carrier particles;

an upstream side developing roller that supports the developer which is mixed and agitated by the developer agitating member, conveys the developer to a facing position opposite to a photoreceptor drum which carries a latent image, and develops the latent image carried by the photoreceptor drum by making toner particles in the developer to adhere to the latent image under a bias voltage composed of a DC bias and an AC bias; and a downstream side developing roller that is located at a downstream side of the upstream side developing roller in the rotating direction of the photoreceptor drum, supports the developer handed over from the upstream side developing roller, conveys the developer to the facing position opposite to a photoreceptor drum which carries the latent image, and develops the latent image carried by the photoreceptor drum by making toner particles in the developer to adhere to the latent image under a bias voltage composed of a DC bias and an AC bias;

wherein the toner in the developer handed over from the upstream side developing roller to the downstream side developing roller has a volume average particle size $D_{T2}$ larger than a volume average particle size $D_{T0}$ of the toner in the developer conveyed by the upstream side developing roller to the facing position between the upstream side developing roller and the photoreceptor drum $$D_{T0}<D_{T2}.$$

2. The developing device described in claim 1, wherein a difference ΔD (μm) between the volume average particle size $D_{T0}$ (μm) and volume average particle size $D_{T2}$ (μm) satisfies the following formula $$0.1\leq\Delta D\leq1.0.$$

3. The developing device described in claim 1, wherein the volume average particle size $D_{T0}$ (μm) satisfies the following formula $$5.0\leq D_{T0}\leq10.0.$$

4. The developing device described in claim 1, wherein when ΔV represents a difference in electric potential between the DC bias applied to the upstream side developing roller and an electric potential of image portions in the latent image on the photoreceptor drum, and $V_{AC}$ represents a peak-to-peak value of the AC bias applied to the upstream side developing roller, the following conditional formula is satisfied $$V_{AC}/\Delta V\geq0.7.$$

5. The developing device described in claim 1, wherein the upstream side developing roller comprises a magnet roller and a developing sleeve which incorporates the magnet roller therein, and when $D_{TO}$ (μm) represents a volume average particle size of toner in the developer which is mixed and agitated by the developer agitating member and $D_D$ (μm) represents a volume average particle size of carrier in the developer, a range of a ten point average roughness (μm) on a surface of the developing sleeve is $D_D/8\leq R_Z$, and a range of an average convex interval SM (μm) on a convexo-concave rough surface is $2D_{TO}\leq Sm\leq2D_D$.

6. The developing device described in claim 1, wherein the upstream side developing roller and the downstream side developing roller are rotated in the same direction as the rotating direction of the photoreceptor drum at respective facing positions opposite to the photoreceptor drum.

7. The developing device described in claim 1, wherein image portions on the photoreceptor drum are developed by the upstream side developing roller, and thereafter, developed by the downstream side developing roller.

8. The developing device described in claim 1, wherein the downstream side developing roller has a line speed larger than that of the upstream side developing roller.

9. The developing device described in claim 1, wherein a gap distance between the downstream side developing roller and the photoreceptor drum is smaller than that between the upstream side developing roller and the photoreceptor.

* * * * *